US005743178A

United States Patent [19]

Babbini

[11] Patent Number: 5,743,178

[45] Date of Patent: Apr. 28, 1998

[54] SCREW PRESS FOR DEHYDRATING FIBROUS MATERIALS

[75] Inventor: Lionello Babbini, Galeata, Italy

[73] Assignee: F.Lli Babbini di Lionello Babbini & C. S.a.s., Civitella di Romagna, Italy

[21] Appl. No.: 742,617

[22] Filed: Nov. 1, 1996

[30] Foreign Application Priority Data

Nov. 10, 1995 [IT] Italy ..... BO95A0532

[51] Int. Cl.[6] ..... B30B 9/16

[52] U.S. Cl. ..... 100/127; 100/145; 100/146

[58] Field of Search ..... 100/117, 127, 100/145, 146

[56] References Cited

U.S. PATENT DOCUMENTS

| | | | |
|---|---|---|---|
| 816,446 | 3/1906 | Fiddyment et al. | 100/127 |
| 3,104,420 | 9/1963 | Selbach . | |
| 4,131,371 | 12/1978 | Tynan . | |
| 4,300,839 | 11/1981 | Sakagami . | |
| 4,457,227 | 7/1984 | Koch | 100/117 |

FOREIGN PATENT DOCUMENTS

| | | | |
|---|---|---|---|
| 0358837 | 3/1990 | European Pat. Off. . | |
| 1622159 | 1/1991 | U.S.S.R. | 100/146 |
| 1106482 | 3/1968 | United Kingdom | 100/145 |
| 81/03639 | 12/1981 | WIPO . | |

*Primary Examiner*—Stephen F. Gerrity
*Attorney, Agent, or Firm*—Guido Modiano; Albert Josif

[57] ABSTRACT

A screw press for squeezing out liquid from a fibrous material including a screen cage having an inlet for the material to be pressed and an outlet for the pressed material, a pair of parallel Archimedean screws, rotatably arranged inside the screen cage, each of the Archimedean screws having a main thread extending around a shaft with a height and a pitch decreasing in the direction from the inlet towards the outlet. Around each shaft and between the turns of each main thread, an auxiliary thread is provided having a reduced height with respect to the height of the main thread, and the auxiliary thread of an Archimedean screw is arranged close to the main thread of the other Archimedean screw at least along the portion of the main thread having a lesser height.

4 Claims, 4 Drawing Sheets

SCREW PRESS FOR DEHYDRATING FIBROUS MATERIALS

BACKGROUND OF THE INVENTION

The present invention relates to a screw press for dehydrating fibrous materials.

Presses of this kind are employed for squeezing out fluids contained into fibrous materials; such presses are usually employed for processing sugar-beets, for expelling oils and producing meals for fodders from residues of fish and the like.

Conventional presses usually comprise two or more helicoidal elements (hereinafter defined as Archimedean screws for the sake of clearness) which rotate in a screen cage. The material to be pressed out is fed into the cage at one end thereof and caused to advance to the opposite end by the Archimedean screws. During advancing the material is pressed so that the liquid squeezed out is drained through the screen cage, while the press cake is expelled through a discharge opening at the opposite end of the screen cage.

Presses of this type are disclosed in the following patents: U.S. Pat. Nos. 4,565,124, 4,438,691; UK 677,794; FR 802,503; JP 54-149976.

Squeezing out of fluid in conventional presses is achieved by progressively reducing the cross-section of the channel between the turns of the Archimedean screw by reducing the height of the threads of the Archimedean screw and the pitch between the turns of the Archimedean screw.

In conventional presses, particularly in presses having two Archimedean screws, the greater the thrust and the pressure are, the lesser is the quantity of material pressed by every thread and the lesser is the quantity of material which, instead of advancing axially, is entrained in rotation together with the threads since in the interference channel between adjacent threads the rotation cannot be efficaciously restrained.

SUMMARY OF THE INVENTION

The aim of the present invention is therefore to provide an improved screw press by which a remarkable increase of efficiency may be achieved.

Within this aim, an object of the present invention is to provide a press wherein a performance increase is also assured in the case that materials having different consistency are processed.

This aim, this object and others which will become apparent hereinafter are achieved by a screw press for squeezing out liquid from a fibrous material comprising a screen cage having an inlet for the material to be pressed and an outlet for the pressed material, a pair of parallel Archimedean screws, rotatably arranged inside said screen cage, each of said Archimedean screws having a main thread extending around a shaft with a height and pitch decreasing in the direction from said inlet towards said outlet, characterized in that around each shaft and between the turns of each main thread an auxiliary thread is provided having a reduced height with respect to the height of said main thread, and in that the auxiliary thread of an Archimedean screw is arranged close to the main thread of the other Archimedean screw at least along the portion of said main thread having a lesser height.

BRIEF DESCRIPTION OF THE DRAWINGS

Further characteristics and advantages of the present invention will become apparent from the following detailed description of a preferred embodiment thereof, illustrated by way of non-limitative example in the accompanying drawings, wherein.

DESCRIPTION OF THE PREFERRED EMBODIMENTS

Figure 1:
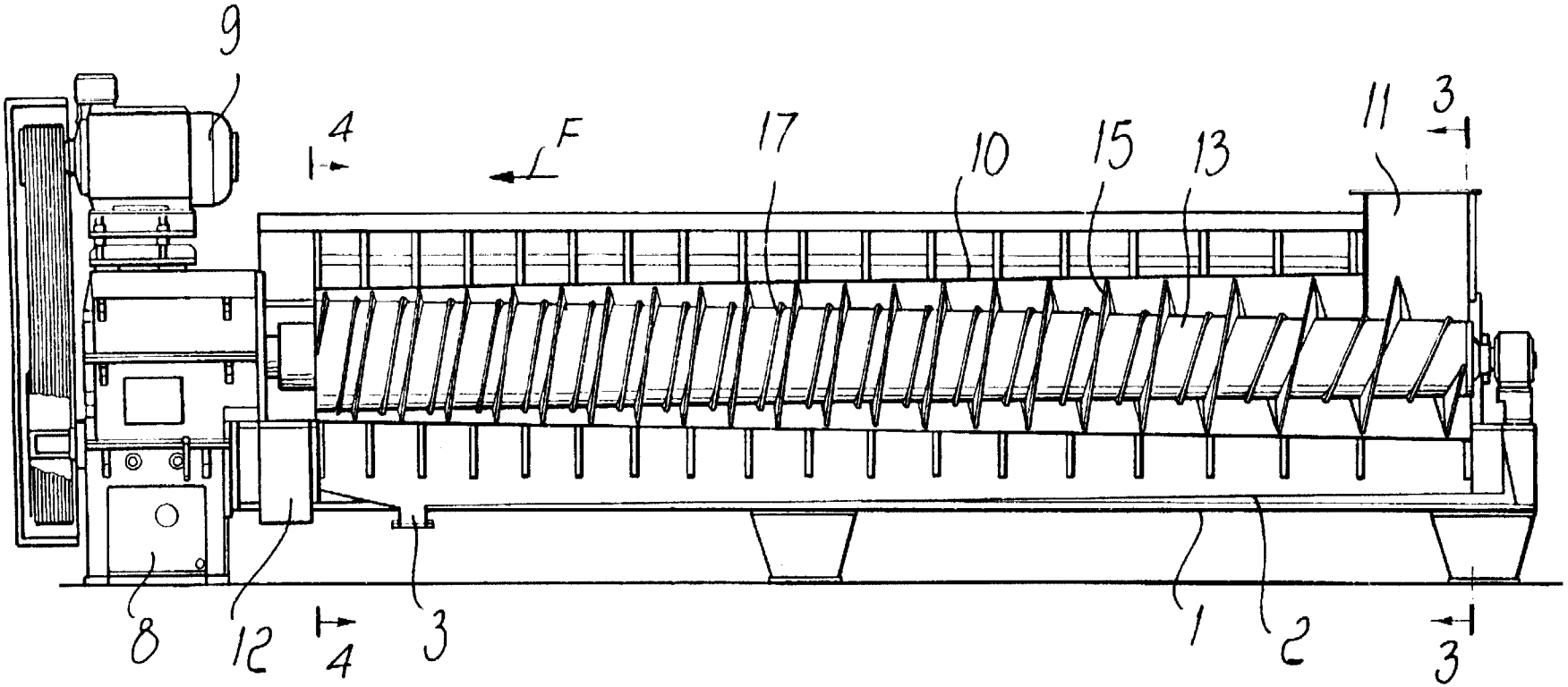
FIG. 1 is an elevational and longitudinal section view of a press according to the present invention.
Figure 2:
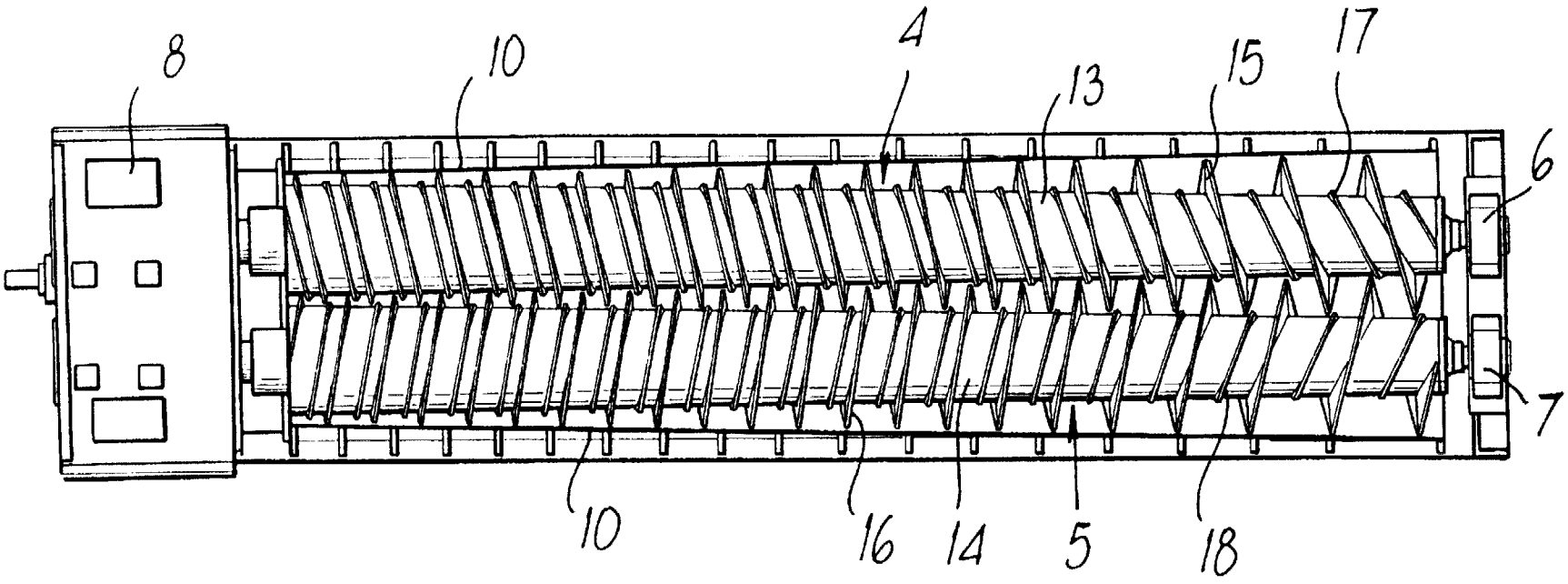
FIG. 2 is a section plan view of the press shown in FIG. 1.
Figure 3:
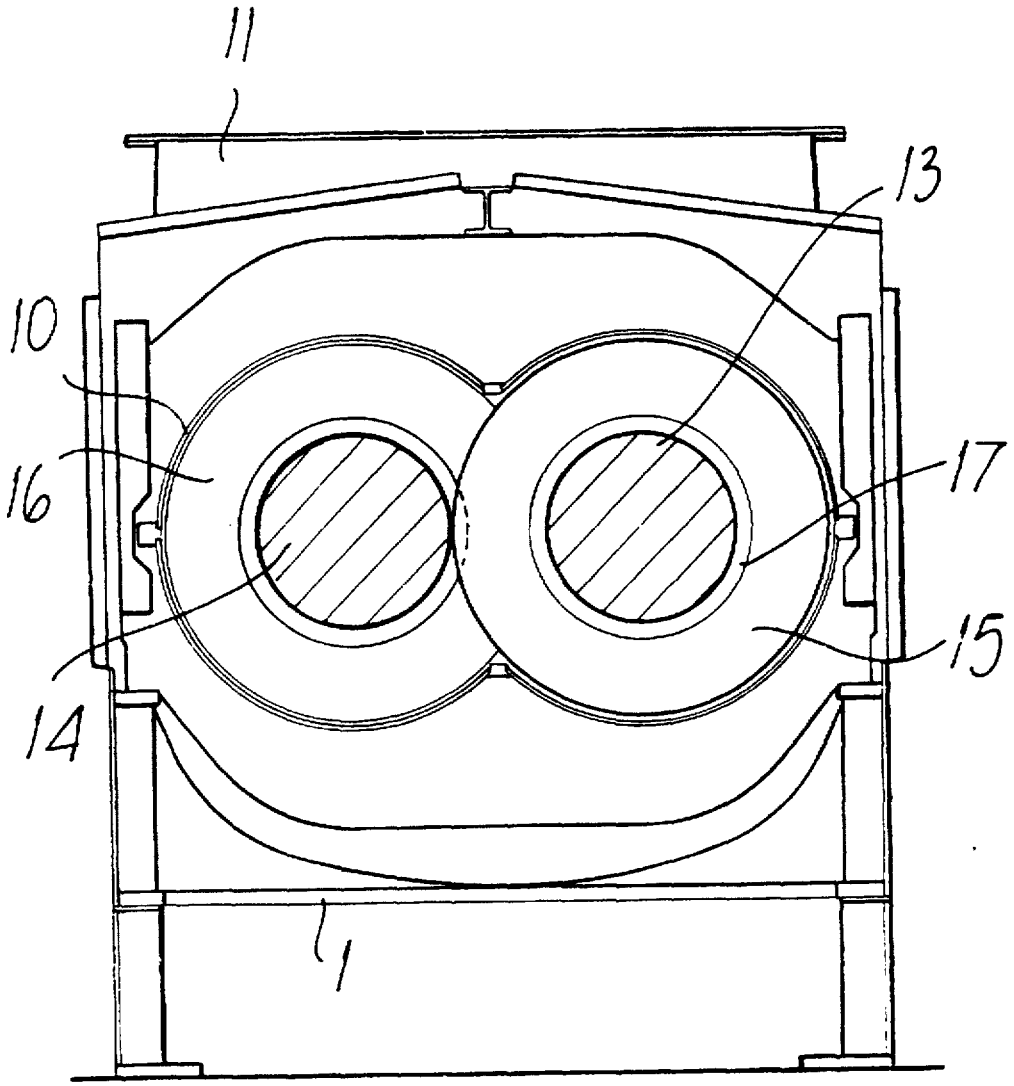
FIG. 3 is a cross-section view taken along line 3—3 of FIG. 1.
Figure 4:
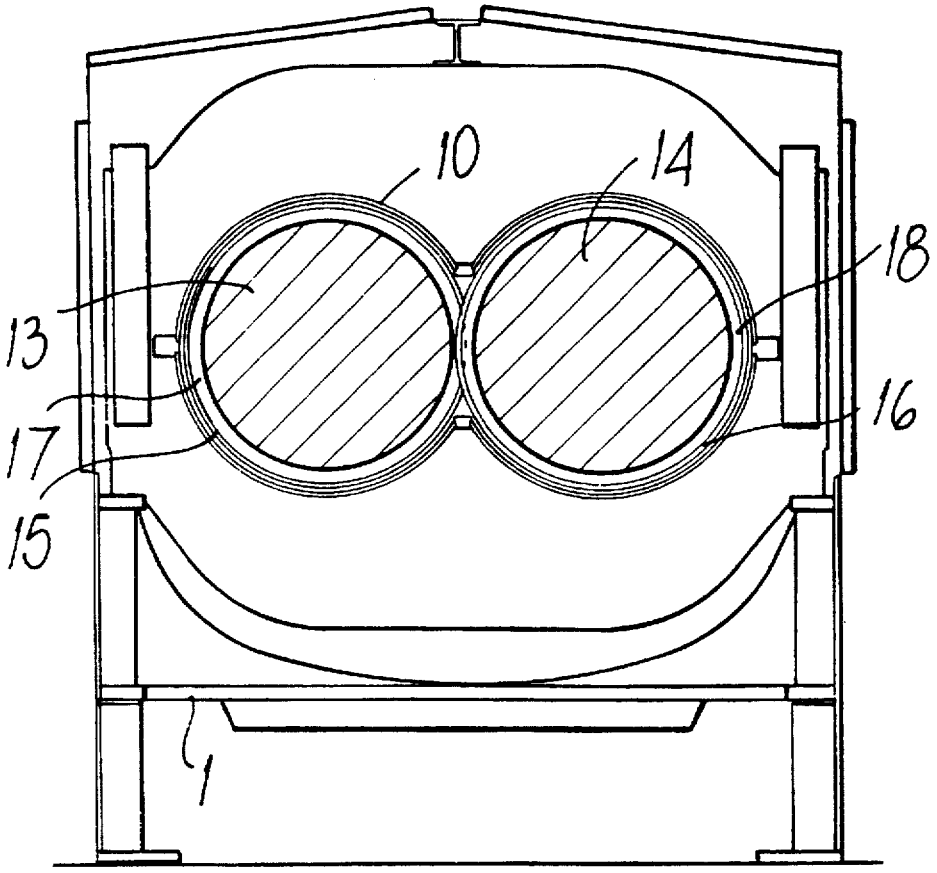
FIG. 4 is a section view taken along line 4—4 of FIG. 1.

With reference to the above cited figures, the press comprises a base 1 on which a tray is arranged for collecting the liquid squeezed out during the pressing process and for conveying it to a drainage opening 3.

Above the tray 2 there are provided two horizontally arranged cilindrical parallel Archimedean screws 4,5 which, at one end, are rotatably supported in supports 6,7. The opposite ends of the Archimedean screws 4,5 are supported in a reduction gearing 8, through which they are driven by an electromotor 9 installed thereon.

Around the Archimedean screws 4,5 a screen cage 10 is arranged which follows the profile of the said Archimedean screws. At the end near to the supports 6,7, the screen cage 10 is provided with an inlet opening 11 through which the material to be pressed is fed into the cage. At the opposite end of the screen cage 10, near to the gearing 8, the outlet opening 12 for discharging the squeezed out mass is arranged.

The Archimedean screws 4,5 are each comprising a shaft 13,14 having a conical cross-section the diameter whereof reduces from the inlet opening 11 towards the outlet opening 12. Around each shaft 13,14 a thread 15,16 extends which, with respect to its function, is defined as main thread. Each thread 15,16 has a constant external diameter, while the internal diameter, owing to the conical surface of the shaft, is progressively increasing from the inlet opening 11 towards the outlet opening 12.

Therefore, the height of the threads 15,16 reduces towards the outlet opening and causes a reduction of the cross-section of the channels defined by the turns of the threads. The cross-section of these channels is further reduced by the fact that the pitch of the threads reduces from inlet opening 11 towards outlet opening 12. The height of the threads 15,16 is such that the edge of the thread of an Archimedean screw is tangential to the surface of the shaft of the adjacent Archimedean screw.

The substantial feature of the present invention resides in the fact that between adjacent turns of the threads 15,16 a further thread is arranged, hereinafter defined as auxiliary thread and designated by reference numerals 17,18.

Figure 5:
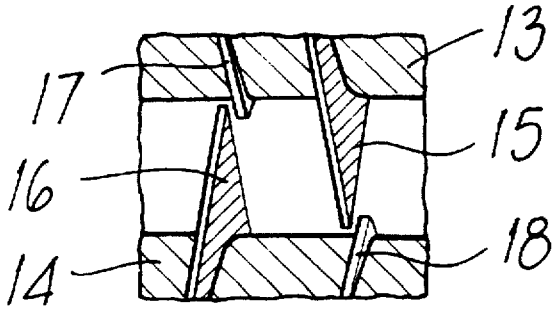
FIG. 5 is an enlarged detail view of the press.

As clearly shown in FIG. 5, the auxiliary thread 17,18 of an Archimedean screw is contiguous to the main thread of the adjacent Archimedean screw and more exactly the auxiliary threads are arranged behind the main threads at the interference portion thereof with respect to the advancing direction F of the material inside the press.

The auxiliary threads 17,18 have a reduced height with respect to the height of the main threads 15,16.

During operation of the press, the auxiliary threads 17,18, owing to their reduced height, have no practical effect along the portion of the press immediately following the inlet opening 11. In fact, along this portion the auxiliary threads do not hinder feeding of the material through the opening 11, thus permitting filling of the space between the turns of the main threads with great quantities of material. This is particularly relevant in connection with the processing of fibrous or filamentous material. Along the first portion the increase of the axial thrust due to the auxiliary threads is insignificant, but anyhow such a thrust would not be necessary since the material has not been compressed yet.

As the material advances towards the outlet opening 12 and the main threads 15,16 reduce their height, the compression of the material inside the press increases. However, since the relative height of the auxiliary threads 17,18 increases with respect to that of the main threads 15,16, the thrust on the material due to the auxiliary threads is also increasing.

Since increasing of the axial thrust causes an increase of the compression to which the material is subjected, an increase of efficiency of the press is achivied and therefore a greater quantity of liquid may be extracted from the material.

Of great importance is the adjacency of the auxiliary threads to the main threads which causes a significant increase of the interference of the threads which is essential to gain a good efficiency in that the central interference zone avoids that the material be brought in rotation together with the threads and aids axial advancing of the material. Rotation of the material, if not prevented, would cause unhomogeneity of the pressing operation and consequently pressure drop of the material inside the press and reduction of the performance of the press with a higher energy consumption since the energy used to press the material would be considered wasted owing to the fact that the material "deflates".

It will appear evident that the press according to the present invention achieves the intended aim and objects. In particular the invention may be applied to presses wherein the Archimedean screws have a tangential velocity which at the interference zone is directed upwards or downwards.

The press according to the present invention is susceptible of numerous modifications and variations all of which are within the scope of the inventive concept as recited in the appended claims.

A first embodiment provides that the auxiliary threads 17,18 are arranged downstream of the main threads 15,16 with respect to the direction F.

In a second embodiment a pair of auxiliary threads for each Archimedean screw are provided, arranged immediately upstream and downstream of the main thread.

In a further embodiment of the invention the conical shafts 13,14 are provided with peripheral perforations which lead to axial channels for conveying the squeezed out liquid to a drainage opening.

Finally, the invention may be applied to presses having a number of Archimedean screws greater than two.

What is claimed is:

1. A screw press for squeezing out liquid from a fibrous material comprising a screen cage having an inlet for the material to be pressed and an outlet for the pressed material, a pair of parallel Archimedean screws, rotatably arranged inside said screen cage, each of said Archimedean screws having a main thread extending around a shaft with a height and a pitch decreasing in the direction from said inlet towards said outlet, wherein around each shaft and between the turns of each main thread an auxiliary thread is provided having a reduced height with respect to the height of said main thread, and wherein the auxiliary thread of an Archimedean screw is arranged close to the main thread of the other Archimedean screw at least along the portion of said main thread having a lesser height.

2. A screw press according to claim 1, wherein said auxiliary thread is arranged upstream of and adjacent to the respective main thread.

3. A screw press according to claim 1, wherein said auxiliary thread is arranged downstream of and adjacent to the respective main thread.

4. A screw press according to claim 1, wherein each of said auxiliary threads extends along a portion of said Archimedean screws.

* * * * *